United States Patent [19]

Edson

[11] 4,194,637

[45] Mar. 25, 1980

[54] MOLDED PEG STRIP

[75] Inventor: Sydney Edson, New York, N.Y.

[73] Assignee: Textron Inc., Providence, R.I.

[21] Appl. No.: 907,512

[22] Filed: May 12, 1978

[51] Int. Cl.[2] ..... A47F 5/00

[52] U.S. Cl. ..... 211/96; 211/59.1; 248/221.4

[58] Field of Search ..... 211/87, 54.1, 57.1, 211/59.1, 96, 105.1; 248/221.3, 221.4, 220.2

[56] References Cited

U.S. PATENT DOCUMENTS

| | | | |
|---|---|---|---|
| 2,572,797 | 10/1951 | Zimmer | 211/87 |
| 2,926,824 | 3/1960 | St. Clair | 211/96 X |
| 3,252,678 | 5/1966 | Myers et al. | 211/59.1 X |
| 3,452,954 | 7/1969 | Lucietto et al. | 211/105.1 X |
| 4,026,508 | 5/1977 | Ziegler | 211/59.1 X |
| 4,114,763 | 9/1978 | Hochman | 211/57.1 |

FOREIGN PATENT DOCUMENTS

| | | | |
|---|---|---|---|
| 812600 | 5/1969 | Canada | 211/59.1 |

*Primary Examiner*—Roy D. Frazier
*Assistant Examiner*—Robert W. Gibson, Jr.
*Attorney, Agent, or Firm*—O'Brien & Marks

[57] ABSTRACT

A molded plastic peg strip for mounting on a display support a plurality of metal hooks from which merchandise bearing cards are hung has a laterally extending series of open top pockets projecting integrally from a transversely flexible base, each pocket being formed by a low front wall connecting the lower portions of two higher laterally spaced side walls which have slight transverse ribs in their upper portions to constrict the pocket width between said ribs for snapping of the side walls over the shank of a hook when the foot of the hook is pushed down into the pocket to seat the shank down on the top of the pocket front wall or seat the end of the foot on the bottom of the pocket.

2 Claims, 8 Drawing Figures

MOLDED PEG STRIP

BACKGROUND OF THE INVENTION

Field of the Invention

Throughout the aisles of present day retail merchandising establishments such as drug, hardware and variety stores, supermarkets and the notions sections of department stores, a great variety of small, inexpensive goods is kept on display for ready visibility and removal by customers. These items are often "carded", i.e., individually mounted on small rectangular pieces of paperboard, frequently under a transparent plastic "bubble", and are hung in quantities from metal hooks outstanding in large numbers from some conveniently located vertical surface such as a wall or partition or the curved surface of a "tower" freestanding on the floor or, in shorter form, set on a counter. Each hook has a long shank extending right-angularly out from the wall or other support and a short terminal foot downturned from the distal end of the shank and seated in a pocket or notch formed in or on the wall. A considerable number of generally identical cards, each formed with a hook-receiving perforation, are hung in horizontal stack arrangement on each shank.

In order to afford versatility in accommodating numerous different arrangements of hook placement suited to cards of a wide range of sizes, the best prior art mounts the hook feet in peg strips which can be fastened to the wall or other supporting surface and which provide a plurality of laterally spaced notches or holes for seating the hook feet at selected spacings.

SUMMARY OF THE INVENTION

The present invention is concerned with such a peg strip and provides certain improvements in the structure and configuration of the series of pockets by which entry of the hooks is facilitated, movement to seated position is made easier, and fixation in seated position is made more secure against inadvertent and undesired withdrawal (as by customers misapplying force in the act of removing cards). The peg strip is well adapted to be made of injection molded polypropylene material and is capable of being mounted on flat or curved surfaces without affecting the form or function of the pocket components. Other advantages and features of the new structure will become apparent as the description hereinafter of a preferred embodiment proceeds.

PRIOR ART STATEMENT UNDER 35 CFR 1.97

The closest prior art of which the inventor is aware are U.S. Pat. No. 2,692,054 to Berglund and U.S. Pat. No. 3,939,985 to Hochman, each of which shows a strip embodying the basic concept of a plurality of open top laterally spaced pockets for seating the feet of metal hook elements having elongated shanks. In neither case, however, is a pocket formed of molded plastic providing side and front wall components height-related to seat the hook shank in constraint against lateral swinging, and in neither case is a pocket ribbed or in any way configured to inhibit undesired uplifting of the hook.

BRIEF DESCRIPTION OF THE DRAWINGS

In the accompanying drawing, which illustrates a preferred embodiment of the invention which has been reduced to practice and given satisfactory results and which is accordingly at present preferred.

DESCRIPTION OF THE PREFERRED EMBODIMENT

Figures 1, 2, 3, 4, 5, 6, 7, 8:
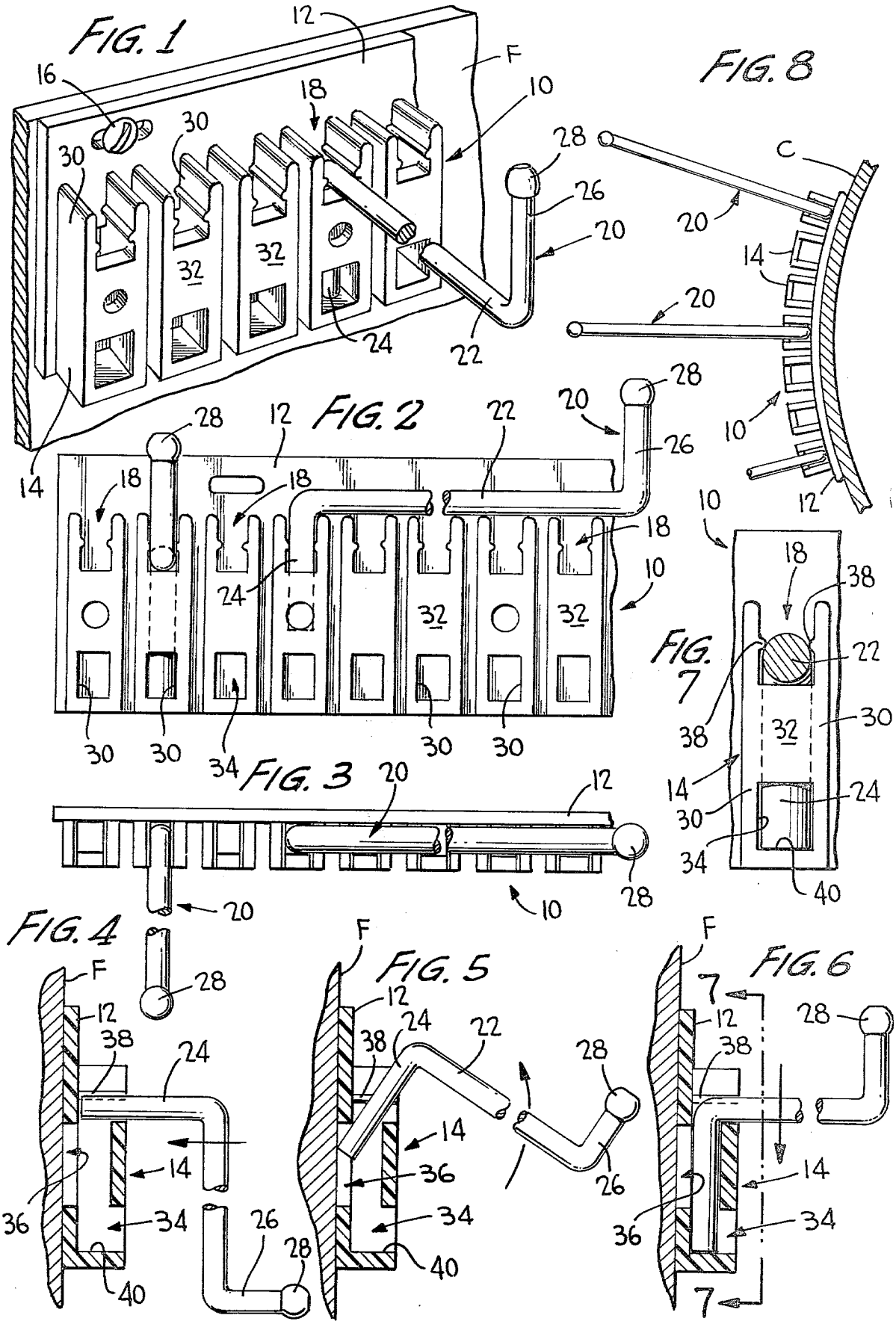
FIG. 1 is a perspective view of the new peg strip, with its ends broken away for economy of space, showing the peg strip installed on a flat wall surface, with a hook in operative position.
FIG. 2 is a front elevational view of one end portion of the strip showing eight of an indefinite number of pockets with which the strip may be provided, and showing two hooks, one in operative and one in inoperative position.
FIG. 3 is a top plan view of the arrangement shown in FIG. 2.
FIG. 4 is a vertical sectional view taken longitudinally centrally through one of the pockets of the strip, showing a hook positioned in the first stage of a sequence of movements by which entry of the hook foot into the pocket, and hence mounting of the hook on the strip, is accomplished.
FIG. 5 is a similar view showing the hook in the second stage of the sequence.
FIG. 6 is a similar view showing the hook moved, after the third stage of the sequence, into fully seated operative position in the pocket.
FIG. 7 is a detail front elevational view of one of the pockets, on an enlarged scale, showing the relation of the hook shank (shown in section on the line 7—7 of FIG. 6) and the hook foot to the configuration of the pocket in the final operative position of the hook.
FIG. 8 is a top elevational view, on a relatively reduced scale, showing the strip applied to a curved supporting surface.

In the accompanying drawings, the reference character F designates the flat surface of a wall, partition or the like, and C the curved surface of a merchandise display "tower" or the equivalent, on either of which is mounted a peg strip 10 made in accordance with the present invention.

The strip is best made as a unitary body of injection molded polypropylene material comprising a base portion 12 and a series of laterally spaced parallel pockets, or pocket structures 14, integrally outstanding from the front surface of the base. The base is rectangular in shape, of indefinite length, and the pockets are equidistantly spaced throughout the length of the base. The pockets are mutually independent and independent of the base in the sense that the base, which is flexible for bending from its normal flat condition of FIG. 1 to the curved condition of FIG. 8, can be flexed without disturbing the position or relations of the pockets, and in the sense that the walls of each pocket can be flexed on entry or removal of a hook, as will be hereinafter explained, without in any way affecting any other pocket or its installed hook.

The strip is designed for mounting on the flat or curved surface F or C in any convenient manner, as by the screws 16 standing through marginal holes formed in the base. In this position the pockets are disposed in horizontal series, each presenting the open top of an elongated vertical cavity or pocket per se 18 formed by upstanding front and side walls, cooperating with a back wall provided by portions of the base, for reception and mounting of a hook 20.

Each of the hooks, which are standard elements used in virtually all the prior art installations, consists of a rod which may be made of substantially three-eights inch round stock bent into a relatively long shank 22 having a right-angularly downturned short foot 24 at its pocketed, proximal end and a short right-angularly upturned terminal portion 26 at its outer or distal end. The hooks are made by shearing suitable sections from a length of rod stock. The distal end portion is mashed down to form a terminal bulbous enlargement for the purpose of inhibiting accidental passage through the perforation in a card hung on the shank and resultant inadvertent removal of the card from the hook. The proximal end is left square cut as sheared; it is not processed for pointing or otherwise trimmed. Consequently difficulty is regularly encountered in entering the feet into the orifices of prior art pockets which are sized as they must be quite exactly to the rod diameter.

In accordance with the principles of the present invention, each pocket 14 is formed by a pair of side walls 30, 30, right-angularly projecting from the base 12, both of the same height, which is slightly more than the length of the foot 24 of the hook 20, by portions of the front surface of the base 12, and by a front wall 32 which connects and bridges the intermediate portions only of the two side walls. The spacing of these components is such that the pocket cavity is substantially square in cross section, each side of the square having a length equal to the diameter of the hook foot, thus providing a snug fit for an inserted foot.

The side walls 30 project above the level of the top of the front wall 32 a distance equal to approximately double the diameter of the shank 22, so that the front of the pocket presents a slotted effect, i.e., the pocket structure is formed with a frontal slot, open at the top, above the level of the front wall top. The front wall terminates a short distance above the bottom of the pocket, leaving an opening 34 in the pocket front. The base 12 is open at 36, directly behind the front wall 32, but imperforate throughout the rest of its extent.

Each of the pocket side walls 30 is formed with a very low transverse protuberance or boss provided by what is probably best designed a rib, as shown at 38, so located and so proportioned as to constrict the effective spacing of the side walls, and hence the width of the pocket bore, to slightly less than the diameter of the hook shank, at a level sightly more than the radius of the shank above the level of the top edge of the front wall 32, all as best shown in FIG. 7.

The effect of the foregoing relationships is that when the foot of a hook has been inserted into the pocket and is fully seated therein, as shown in FIGS. 6 and 7, the two ribs 38 will overlie the adjacent portion of the shank, slightly above the horizontal diametric plane of the shank, and thereby hold the shank down securely against the top edge of the pocket front wall 32, or hold the shank down with the proximal end of the hook seated on the closed bottom 40 of the pocket.

Within the broad principles of the invention, either or both of these final positional relationships of foot in pocket may be achieved, depending on the designer's choice or, to some extent, on the nicety or precision of the mold dimensions. Either one alone is adequate to hold the hook securely against unwanted lifting and withdrawal, that function being performed by the engagement of the ribs 38 with the sides of the shank above the plane of the horizontal diameter of the shank, as shown in FIG. 7.

A particular advantage of the new peg strip is the ease with which the hook foot can be inserted into the pocket cavity notwithstanding the square cut, unreduced end of the foot and the necessity of putting that foot into a zone of the pocket below an inter-rib spacing significantly less than the diameter of the foot end.

The insertion operation is shown by FIGS. 4, 5 and 6, illustrating the sequence of steps by which the final position of the hook shown in FIGS. 6 and 7 is achieved.

As shown in FIG. 4, the operation is begun by pushing the hook foot horizontally across the top of the pocket front wall 32 just beneath the two ribs 38 of the two side walls 30. This requires no expansion of the side walls and no more than minimal force. The hook, with the end of the foot seated against the peg base, is then lifted, as shown in FIG. 5, in an operation in which the sides of the foot (not the end) push the ribs apart on the application of minimal leverage force to the long shank of the hook. With the foot now standing in vertical position, protruding from the pocket, and the shank disposed horizontally well above the level of the tops of the side walls, the hook is pushed down to the limit set by seating of the shank on the front wall top edge and/or by the end of the foot seating on the bottom 40 of the pocket. This pushing step in the operation requires no significant force inasmuch as the merely point contact of each rib line with the curved surface of the foot involves no more than minimal friction. As the shank moves down into final position, the ribs close in a snap action to overlie the shank as best shown in FIG. 7.

As has been explained, the sectional of polypropylene as the preferred material not only makes possible the snap action to final position of the hook but also produces a peg strip the base 12 of which is sufficiently flexible and yieldable to conform to the curved surface C of a display tower or the like. In this distortion from the normal flat plane of the base, the pocket structures remain unaffected, each outstanding right-angularly or radially from the base, as shown in FIG. 8.

It will be evident that the hooks are readily removable by a simple lifting movement. As is also obvious, any hook can, when no card is hanging from its shank, be adjusted to the inoperative retracted position in which the hooks appearing at the right in FIGS. 2 and 3 are shown, without disturbing any adjacent loaded hooks, by simply lifting the foot of the hook sufficiently for its shank to clear the top of the pocket side wall in a swinging movement back into engagement of the shank with the base.

The structure and relationships essential to attaining the foregoing and related advantages of the new peg strip are defined by the appended claims and are subject to variation and modification within the spirit of the invention and the scope of the claims.

What is claimed is:

1. A display support comprising:

a plurality of hooks formed from round stock each having an elongate shank and a downturned foot; and a flexible molded plastic peg strip to hold said hooks, including an elongate laterally flexible base adapted to be attached flush to a flat or curved surface and a plurality of independent equally spaced pockets formed integrally along the length of said base and projecting therefrom, each pocket having two parallel side walls of a height greater than the length of said hook foot, said walls being spaced apart a distance approximately equal to the diameter of said hook foot and extending a like distance from said base, a front wall connecting said side walls below the top edges thereof to form a cavity with a square cross section, a slot defined by the area between the side walls above the front wall to receive the shank of a hook and to prevent horizontal swinging thereof, a bottom surface interconnecting the lower edges of said side walls and said base to provide a stop for said hook foot, and an aperture in said base extending substantially the full width of said cavity from above said bottom surface to below the top edges of said side walls, a portion of said base remaining adjacent said bottom surface to provide lateral support for said hook foot, said aperature facilitating insertion of a hook foot into said cavity by providing rear clearance for said foot to permit the foot to be inserted into the cavity while in substantial angular misalignment therewith.

2. A display support as recited in claim 1 and further comprising an integral rib extending transversely across the inner surface of each side wall from the base to the forward edge of the side wall, said rib being positioned so as to engage the shank of a fully seated hook above its diametral plane to retain the hook in the cavity.

* * * * *